US009547322B1

(12) United States Patent
Tournatory et al.

(10) Patent No.: US 9,547,322 B1
(45) Date of Patent: Jan. 17, 2017

(54) CONFIGURATION MODES FOR OPTIMUM EFFICIENCY ACROSS LOAD CURRENT

(71) Applicant: Gazelle Semiconductor Inc., Redwood City, CA (US)

(72) Inventors: David Tournatory, Redwood City, CA (US); Nicolas Monier, San Francisco, CA (US)

(73) Assignee: Gazelle Semiconductor, Inc., Sunnyvale, CA (US)

( * ) Notice: Subject to any disclaimer, the term of this patent is extended or adjusted under 35 U.S.C. 154(b) by 0 days.

(21) Appl. No.: 14/940,121

(22) Filed: Nov. 12, 2015

Related U.S. Application Data

(60) Provisional application No. 62/079,467, filed on Nov. 13, 2014.

(51) Int. Cl.
*G05F 1/56* (2006.01)

(52) U.S. Cl.
CPC ..... *G05F 1/56* (2013.01)

(58) Field of Classification Search
CPC ..... G05F 1/56
USPC ..... 323/268, 269, 270, 272
See application file for complete search history.

(56) References Cited

U.S. PATENT DOCUMENTS 5,677,618 A * 10/1997 Fiez ..... H02M 3/156 323/282
5,929,692 A * 7/1999 Carsten ..... H02M 1/15 323/271
6,150,803 A * 11/2000 Varga ..... H02M 3/1584 307/60
6,229,289 B1 * 5/2001 Piovaccari ..... H02M 3/1588 323/268
6,639,816 B2 * 10/2003 Liu ..... H02J 1/102 363/65
7,319,311 B2 * 1/2008 Nishida ..... H01M 10/44 323/268
7,432,614 B2 * 10/2008 Ma ..... H02M 3/158 307/31
7,812,580 B2 * 10/2010 Watanabe ..... H02M 3/1588 323/268
8,138,731 B2 * 3/2012 Chen ..... H02M 3/1584 323/272
8,587,268 B1 * 11/2013 Huard ..... H02M 3/158 323/268
8,729,870 B2 * 5/2014 Crawford ..... H05B 33/0815 315/291
8,890,502 B2 * 11/2014 Tournatory ..... H02M 3/156 323/283
8,952,753 B2 * 2/2015 Tournatory ..... H02M 3/156 330/103
9,086,708 B2 * 7/2015 Tournatory ..... H02M 3/158
2007/0200542 A1 * 8/2007 Lee ..... G05F 1/56 323/304
2009/0206813 A1 * 8/2009 Agari ..... G05F 1/56 323/282
2009/0278517 A1 * 11/2009 Kleveland ..... G05F 1/563 323/272
2009/0295344 A1 * 12/2009 Qu ..... G05F 1/56 323/265

(Continued)

*Primary Examiner* — Jue Zhang

(57) ABSTRACT

A voltage regulator circuit and a method to control the voltage regulator circuit. The voltage regulator circuit comprising an AC switching regulator, a DC switching regulator, a linear voltage regulator and switches to configure the voltage regulator circuit for improved efficiency across a wide load range.

7 Claims, 11 Drawing Sheets

(56) References Cited

U.S. PATENT DOCUMENTS

| | | | | |
|---|---|---|---|---|
| 2010/0283438 | A1* | 11/2010 | Chung | G05F 1/575 323/268 |
| 2014/0210266 | A1* | 7/2014 | Tournatory | H02M 3/158 307/31 |
| 2015/0028832 | A1* | 1/2015 | Tournatory | H02M 3/1584 323/271 |
| 2015/0145331 | A1* | 5/2015 | Monier | H02M 1/14 307/26 |
| 2015/0381026 | A1* | 12/2015 | Tournatory | H02M 3/158 323/271 |

* cited by examiner

CONFIGURATION MODES FOR OPTIMUM EFFICIENCY ACROSS LOAD CURRENT

RELATED APPLICATION

The present application claims priority to U.S. Provisional Application No. 62/079,467, filed on Nov. 13, 2014, which is incorporated by reference herein in its entirety.

FIELD

The present invention relates to switching regulators, and more particularly to high efficiency switching regulators.

BACKGROUND

Switching regulators generally have reduced efficiency at very light loads. However, this is suboptimal for some uses.

BRIEF DESCRIPTION OF THE FIGURES

The present invention is illustrated by way of example, and not by way of limitation, in the figures of the accompanying drawings and in which like reference numerals refer to similar elements and in which.

DETAILED DESCRIPTION

In a voltage regulator circuit, it is desirable to have high efficiency at very light loads. Embodiments of the present disclosure include a regulator coupled between an AC switching stage and a DC switching stage of a voltage regulator circuit.

The following detailed description of embodiments of the invention makes reference to the accompanying drawings in which like references indicate similar elements, showing by way of illustration specific embodiments of practicing the invention. Description of these embodiments is in sufficient detail to enable those skilled in the art to practice the invention. One skilled in the art understands that other embodiments may be utilized and that logical, mechanical, electrical, functional and other changes may be made without departing from the scope of the present invention. The following detailed description is, therefore, not to be taken in a limiting sense, and the scope of the present invention is defined only by the appended claims.

Figure 1:
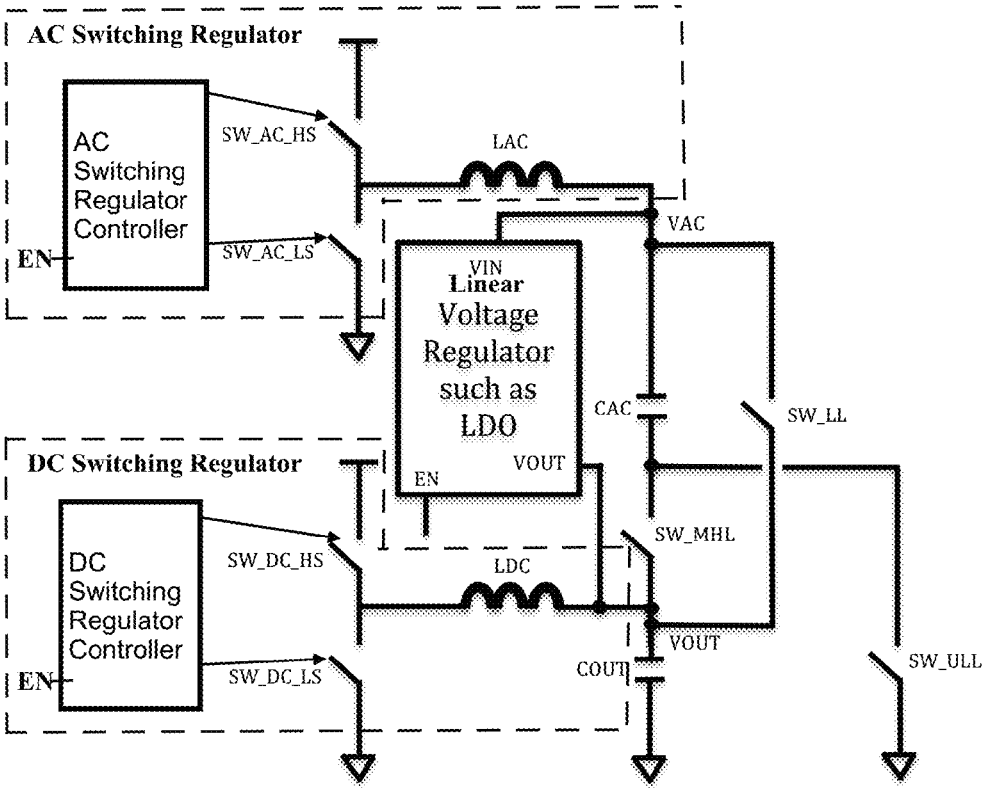
FIG. 1 is a circuit diagram of a voltage regulator circuit, in accordance with one embodiment of the present invention.

FIG. 1 is a circuit diagram of a voltage regulator circuit, in accordance with one embodiment of the present invention. The voltage regulator includes a plurality of switches which switch in and out an AC switching stage and a DC switching stage, using inductors (LAC, LDC) and a capacitor (CAC). By changing the circuit elements switched into the voltage regulator circuit, the voltage regulator can be optimized for different load levels. The elements that may be active or inactive include an AC switching regulator, a DC switching regulator, and a linear voltage regulator. In one embodiment, the linear voltage regulator is a low drop-out regulator (LDO).

Figure 2:
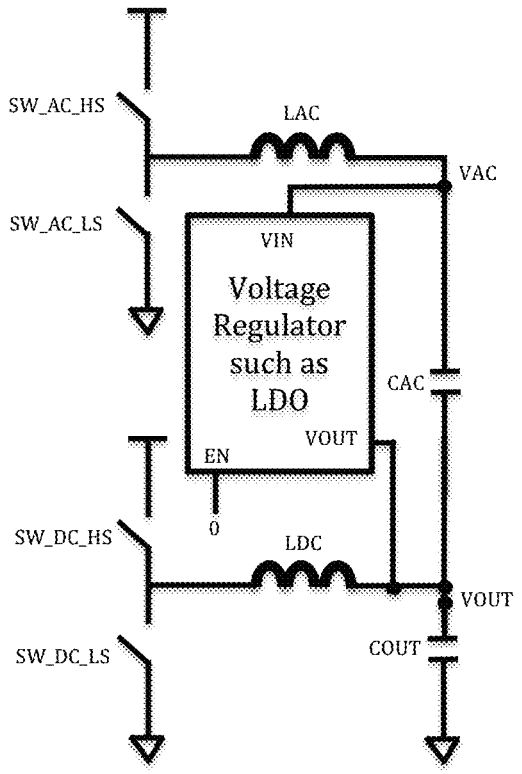
FIG. 2 is one embodiment of the circuit of FIG. 1, configured for medium to high current mode.

FIG. 2 shows one embodiment of the configuration of the circuit of FIG. 1 for medium to high current load mode. In this case, SW_LL is Open, SW_MHL is Closed, SW_ULL is Open, and the LDO (Or Voltage regulator) is disabled. Switcher AC (SW_AC_HS and SW_AC_LS) is enabled continually and Switcher DC (SW_DC_HS and SW_DC_LS) is enabled continually.

Figure 3:
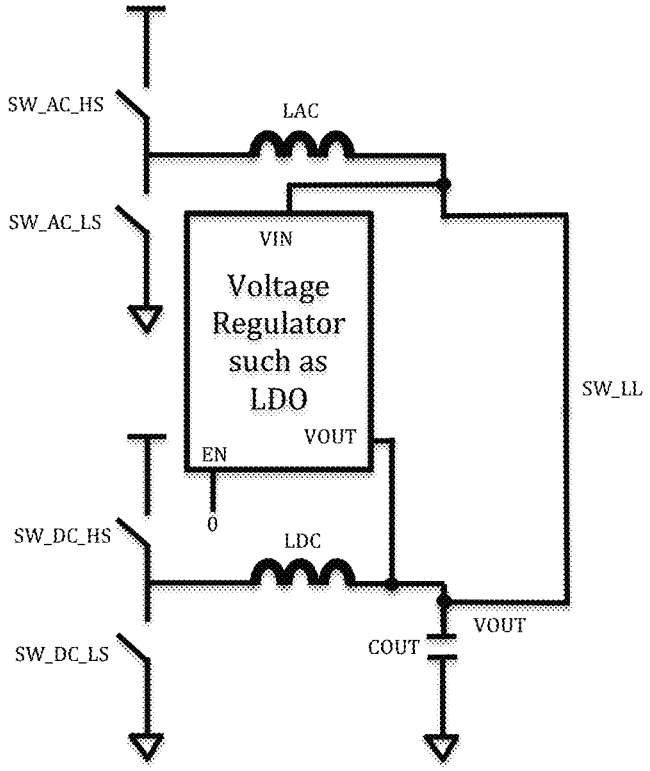
FIG. 3 is one embodiment of the circuit of FIG. 1, configured for Light Load mode.

FIG. 3 shows one embodiment of the configuration of the circuit in FIG. 1 for Light Load mode. In this case, SW_LL is Closed, SW_MHL is Open, SW_ULL is Open and the LDO (or voltage regulator) is Disabled. In this case, Switcher AC is enabled continually and Switcher DC is disabled.

Figure 4:
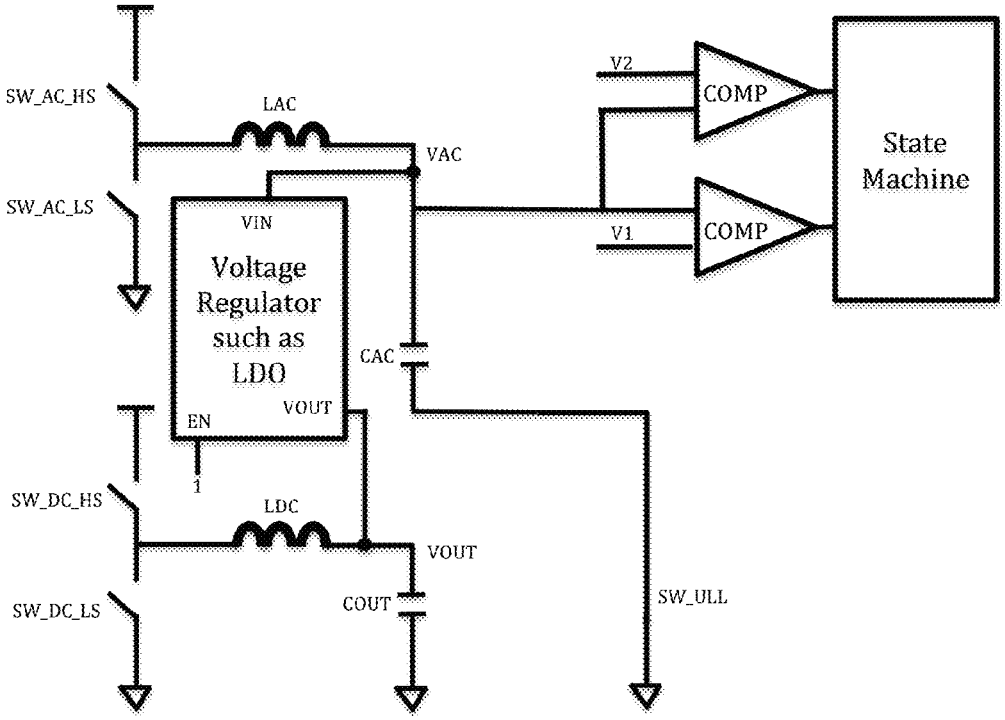
FIG. 4 is one embodiment of the circuit of FIG. 1, configured for Ultra Light load mode.

FIG. 4 shows one embodiment of a configuration of the circuit in FIG. 1 for Ultra Light load mode. In this case, SW_LL is Open, SW_MHL is Open, SW_ULL is Closed, and LDO (or Voltage regulator) is Enabled. Switcher AC is enabled periodically (by the state machine) and Switcher DC disabled.

In one embodiment, a threshold detection circuit (here, two comparators and a state machine) monitors the voltage on the VAC node at the output of the AC switching stage. During Phase 1, Switcher AC (Formed by SW_AC_HS, SW_AC_LS, LAC_CAC) charges VAC from V1 to V2 with an output current corresponding to its maximum efficiency and the Voltage regulator or LDO Regulates the Vout voltage at a reference voltage Vref (not shown in FIG. 4). During Phase 2, Switcher AC is disabled and the Voltage regulator or LDO regulates Vout at Vref and discharges VAC from V2 to V1, to keep the voltage between the predefined limits of V1 and V2.

Figure 5:
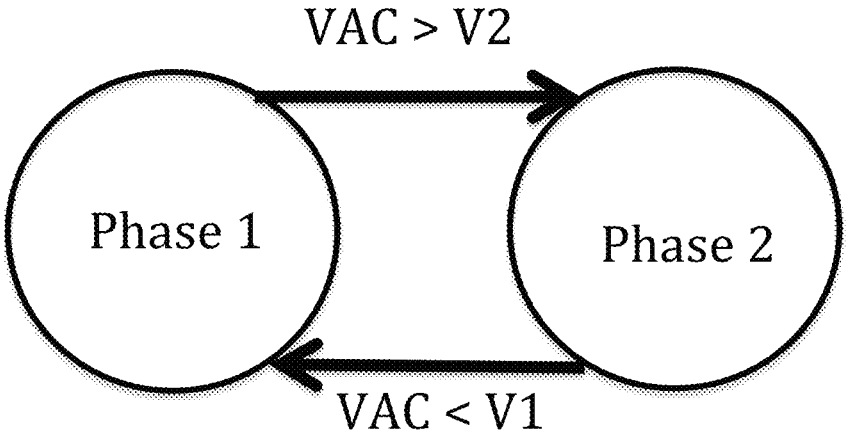
FIG. 5 shows one embodiment of the Phase 1 and 2 cycling in Ultra Light Load Mode.

FIG. 5 Shows the Phase 1 and 2 cycling in Ultra Light Load Mode. Operation in Ultra Light Load mode, the system switches between Phase 1, and Phase 2

In Phase 1: Switcher AC (Formed by SW_AC_HS, SW_AC_LS, LAC_CAC) charges VAC from V1 to V2 with an output current corresponding to its maximum efficiency. Voltage regulator or LDO Regulates the Vout voltage at Vref.

In Phase 2: Switcher AC is disabled, Voltage regulator or LDO regulates Vout at Vref and discharges VAC from V2 to V1.

Figure 6:
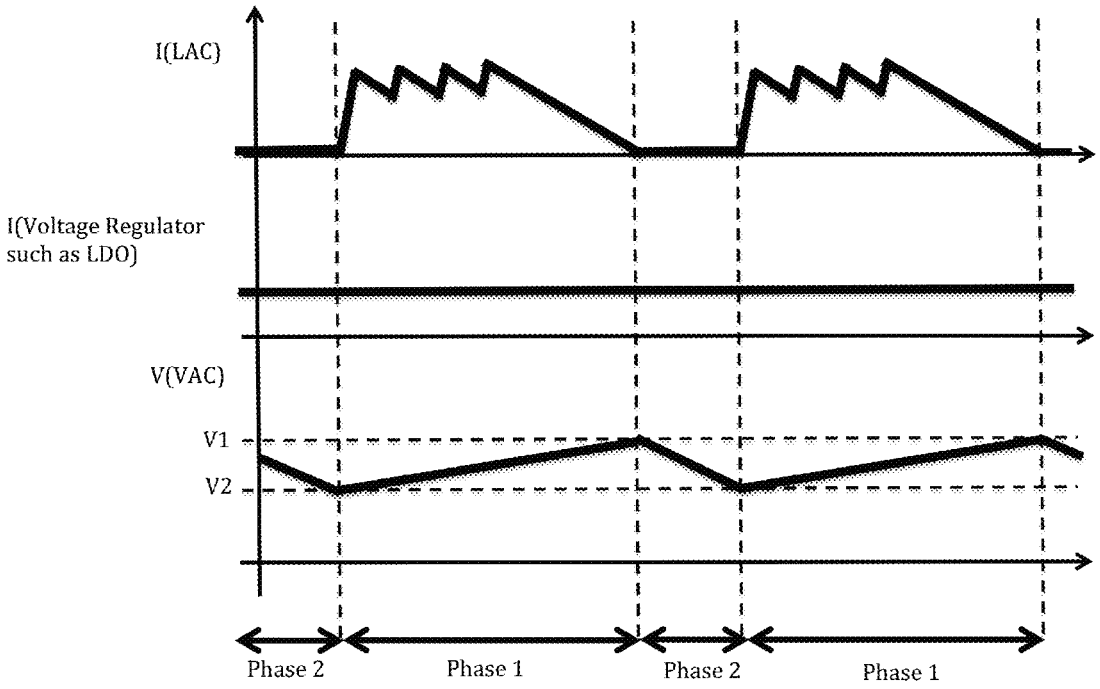
FIG. 6 shows one embodiment of time domain waveforms of current and voltage during phase 1 & 2 cycling in Ultra Light Load mode.

FIG. 6 shows the time domain waveforms of current and voltage during phase 1 & 2 cycling in Ultra Light Load mode.

Figure 7:
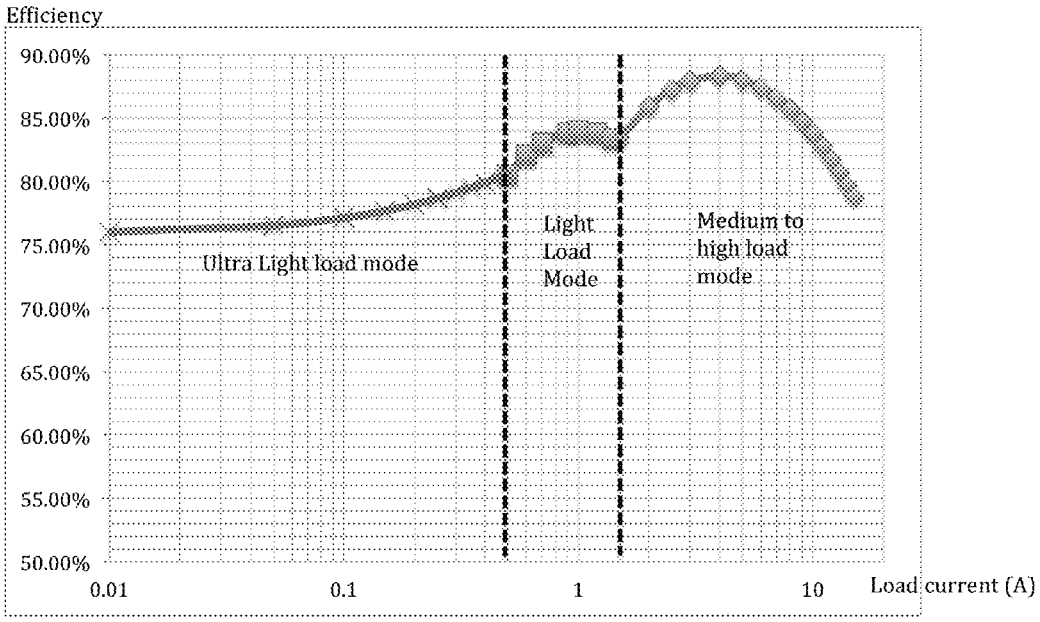
FIG. 7 shows one embodiment of the efficiency across the different modes and the entire load current range.

FIG. 7 shows exemplary efficiency across the different modes and the entire load current range.

Phase 1 Power Losses for Switcher AC:

$$Eff_SW_AC = Iout \times Vout / (Iout \times Vout + P_SW_AC)$$

$$P_SW_AC = I\text{out_peak}_eff \times (V1+V2)/2 \times (1-Eff_SW_AC)/Eff_SW_AC$$

Assuming:
Iout_peak_eff=1 A
V1=1V
V2=1.2V
Eff_SW_AC=80%
→P_SW_AC=275 mW
Time to Recharge VAC from V1 to V2:

$$T_\text{recharge} = CAC \times (V2-V1)/I\text{out_peak}\ eff$$

Assuming:
Iout_peak_eff=1 A
V1=1V
V2=1.2V
CAC=10 uF
→T_recharge=2 us
Phase 2 Duration:

$$T_\text{dischage} = CAC \times (V2-V1)/I\text{load}$$

Assuming:
Iload=20 mA
V1=1V
V2=1.2V
CAC=10 uF
→T_discharge=100 us
Average Power Dissipated in the Switcher AC During Phase 1 and Phase 2:

$$P_SW_AC = P_SW_AC_\text{phase1} \times T_\text{charge}/(T_\text{charge}+T_\text{discharge})$$

With the Previous Assumption:

$$P_SW_AC = 10.57\ \text{mW}$$

Average LDO Dissipation During Phase 1 and 2:

$$P_LDO = I\text{Load} \times (V2-V1)/2$$

With the Previous Assumptions:

$$P_LDO = 2\ \text{mW}$$

Ultra Light Load Efficiency:

$$\text{Efficiency}_ULL = I_\text{Load} \times V\text{out}/(P_SW_AC+P_LDO+I_\text{Load} \times V\text{out})$$

With the Previous Assumptions:

$$\text{Efficiency}_ULL = 20\ \text{mA} \times 1\text{V}/(10.57\ \text{m}+2\ \text{m}+20\ \text{m})$$

$$\text{Efficiency}_ULL = 61.4\%$$

Figure 8:
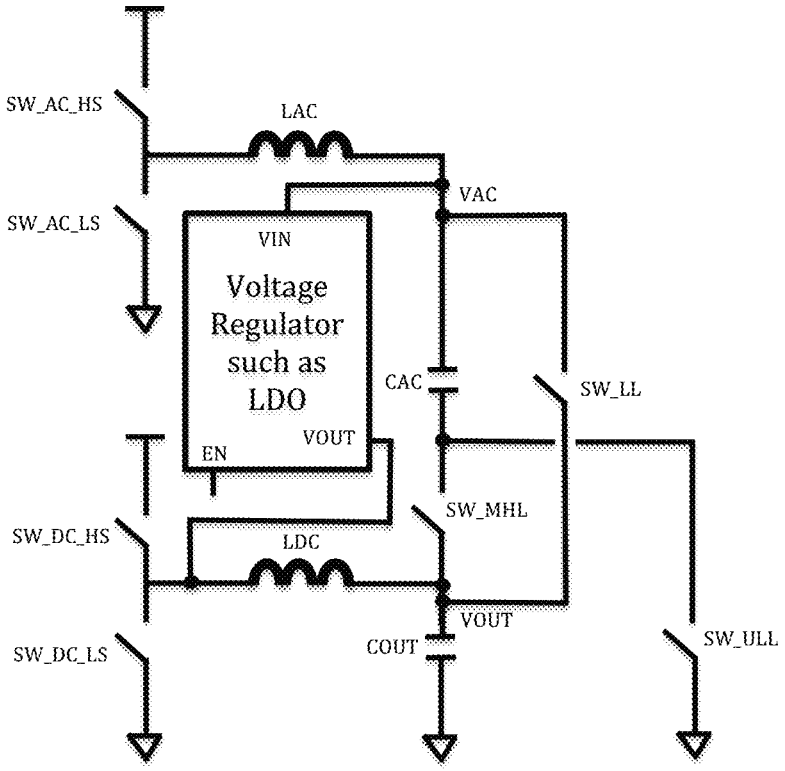
FIG. 8 is a circuit diagram of a voltage regulator circuit, in accordance with another embodiment of the present invention.

FIG. 8 shows a different embodiment of the invention. The voltage regulator includes a plurality of switches which switch in and out inductors (LAC, LDC) and a capacitor (CAC). By changing the circuit element switched into the voltage regulator circuit, the voltage regulator can be optimized for different load levels. As can be seen, the difference between this configuration and the configuration of FIG. 1 is that the Vout connects between SW_DC_HS and SW_DC_LS.

Figure 9:
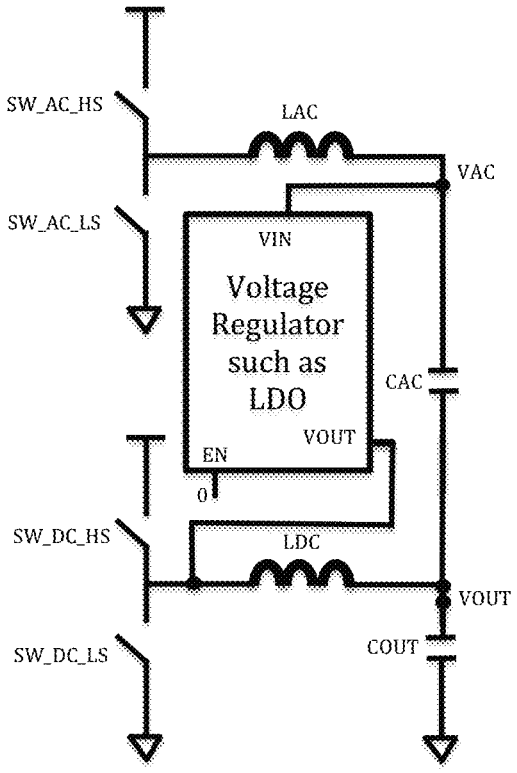
FIG. 9 is one embodiment of the circuit of FIG. 8, configured for medium to high current mode.

FIG. 9 shows one embodiment of a configuration of the circuit in FIG. 8 for medium to high current load mode. In this case, SW_LL is Open, SW_MHL is Closed, SW_ULL is Open, and the LDO (Or Voltage regulator) is disabled. Switcher AC is enabled continually and Switcher DC is enabled continually.

Figure 10:
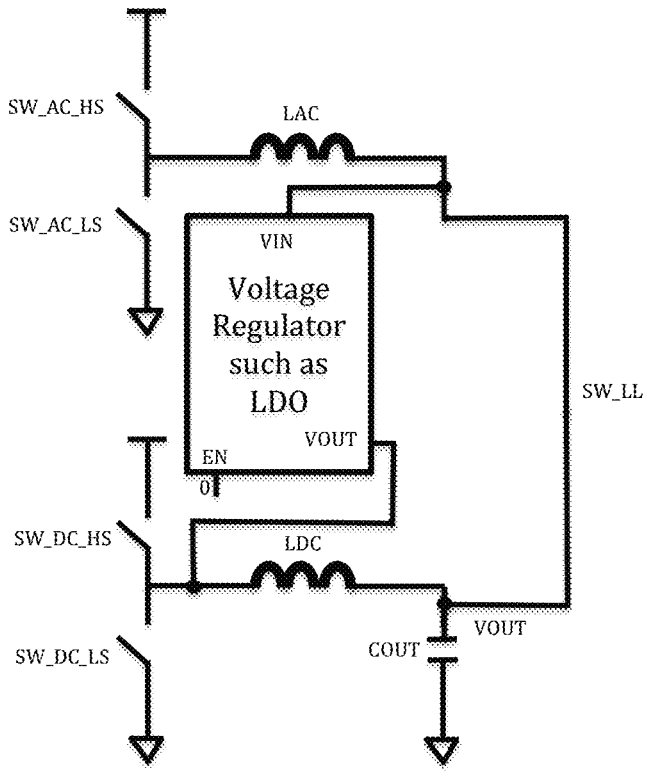
FIG. 10 is one embodiment of the circuit of FIG. 8, configured for Light Load mode.

FIG. 10 shows one embodiment of a configuration of the circuit in FIG. 8 for Light Load mode where SW_LL is Closed, SW_MHL is Open, SW_ULL is Open and the LDO (or voltage regulator) is Disabled. In this case, Switcher AC is enabled continually and Switcher DC is disabled.

Figure 11:
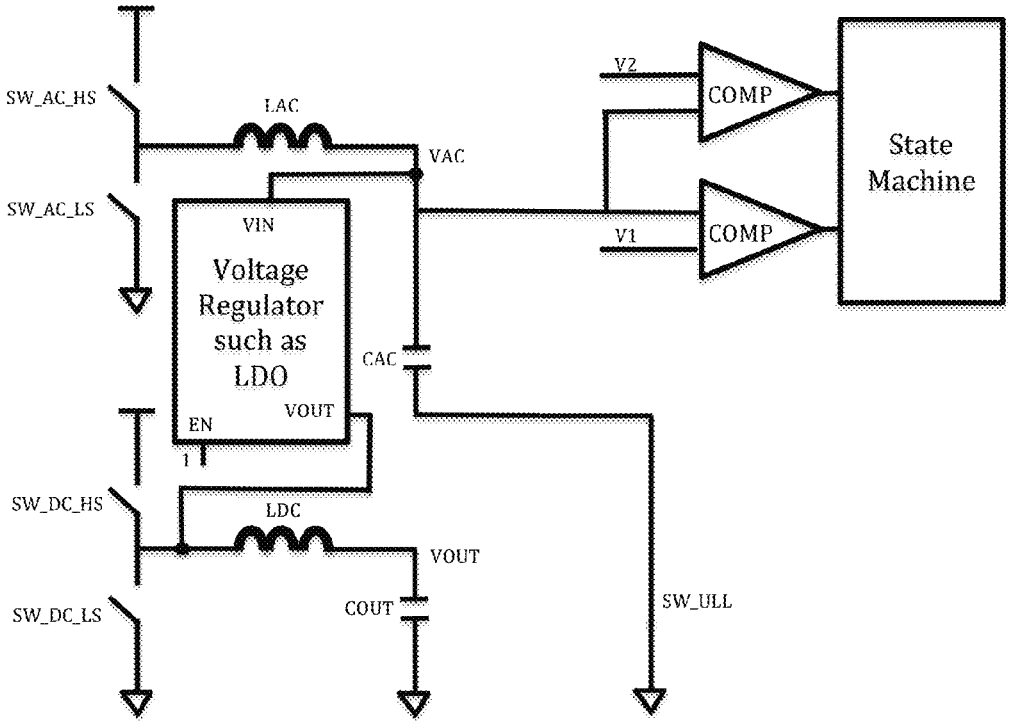
FIG. 11 is one embodiment of the circuit of FIG. 8, configured for Ultra Light load mode.

FIG. 11 shows one embodiment of a configuration of the circuit in FIG. 8 for Ultra Light load mode. In this case, SW_LL is Open, SW_MHL is Open, SW_ULL is Closed, and LDO (or Voltage regulator) is Enabled. Switcher AC is enabled periodically (By the state machine) and Switcher DC disabled.

A threshold detection circuit (here, two comparators and a state machine) monitors the voltage on the VAC node at the output of the AC switching stage. During Phase 1, Switcher AC (Formed by SW_AC_HS, SW_AC_LS, LAC_CAC) charges VAC from V1 to V2 with an output current corresponding to its maximum efficiency and the Voltage regulator or LDO Regulates the Vout voltage at Vref. During Phase 2, Switcher AC is disabled and the Voltage regulator or LDO regulates Vout at Vref and discharges VAC from V2 to V1.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

We claim:

1. A configurable voltage regulator circuit for a range of loads, comprising:
- an AC switching regulator;
- a DC switching regulator;
- a linear voltage regulator;
- a plurality of switches, to configure the voltage regulator circuit, the switches coupling the regulators to the load, such that:
- for medium and greater load mode the AC switching regulator and the DC switching regulator are enabled, and the linear voltage regulator is disabled;
- for ultra light load mode, the AC switching regulator is periodically enabled, the DC switching regulator is disabled, and the linear voltage regulator is enabled, the AC switching regulator enabled periodically to maintain a regulated output voltage to the load.

2. The voltage regulator circuit of claim 1, where the AC switching regulator is enabled by a state machine.

3. The voltage regulator circuit of claim 1, wherein the linear voltage regulator is a low dropout regulator (LDO).

4. A method to control a voltage regulator circuit comprising an AC switching regulator, a DC switching regulator a low drop-out linear regulator (LDO) and switches SW_LL SW_MHL and, SW_ULL to configure the voltage regulator circuit for improved efficiency across a wide load range, the method comprising:
- during medium to high load conditions enabling the AC switching regulator and the DC switching regulator, disabling the LDO, closing switch SW_MHL and opening switches SW_LL and, SW_ULL;
- during light load conditions enabling the AC switching regulator, disabling the DC switching regulator and the LDO, closing switch SW_LL and opening switches SW_MHL and SW_ULL; and
- during ultra-light load conditions periodically enabling the AC switching regulator, disabling the DC switching regulator, enabling the LDO, closing switch SW_ULL and opening switches SW_MHL and SW_LL.

5. The method of claim 3, further comprising:
- step of periodically enabling the AC switching regulator to keep an output voltage of the AC switching regulator between two predefined limits.

6. A method to control a voltage regulator circuit comprising an AC switching regulator, a DC switching regulator, a linear voltage regulator, and switches to configure the voltage regulator circuit for improved efficiency across a wide load range, the method comprising:

during medium to high load conditions enabling the AC switching regulator and DC switching regulator, and configuring the regulators to provide a regulated output voltage to a load, and disabling the linear voltage regulator;

during light load conditions enabling the AC switching regulator and configuring the AC switching regulator to provide a regulated output voltage to the load, and disabling the DC switching regulator and the linear voltage regulator; and during ultra-light load conditions periodically enabling the AC switching regulator and enabling the linear voltage regulator to provide a regulated output voltage to the load, and disabling the DC switching regulator.

7. The method of claim 6, further comprising:

periodically enabling the AC switching regulator to maintain an output voltage of the AC switching regulator between two predefined limits.

* * * * *